US006931998B1

(12) United States Patent
Leese

(10) Patent No.: US 6,931,998 B1
(45) Date of Patent: Aug. 23, 2005

(54) TABLE AND MOUNTING COMBINATION

(76) Inventor: Thomas D. Leese, 62 Valley View Dr., Hanover, PA (US) 17331

( * ) Notice: Subject to any disclaimer, the term of this patent is extended or adjusted under 35 U.S.C. 154(b) by 70 days.

(21) Appl. No.: 10/462,924

(22) Filed: Jun. 18, 2003

(51) Int. Cl.[7] ..... A47B 23/00
(52) U.S. Cl. ..... 108/42; 108/152
(58) Field of Search ..... 108/42, 47, 152, 108/48; 248/235, 248

(56) References Cited

U.S. PATENT DOCUMENTS

| | | | | |
|---|---|---|---|---|
| 3,017,155 | A * | 1/1962 | Scarpetti | 248/235 |
| 3,510,097 | A * | 5/1970 | McCaleb | 248/243 |
| 4,411,400 | A * | 10/1983 | Everett | 248/216.1 |
| 5,033,448 | A | 7/1991 | Sandweg | |
| 5,390,443 | A | 2/1995 | Emalfarb et al. | |
| 5,570,642 | A * | 11/1996 | Lehrman | 108/47 |
| 5,595,128 | A | 1/1997 | De Ladurantaye et al. | |
| 5,653,178 | A * | 8/1997 | Huczka | 108/47 |
| 5,685,517 | A | 11/1997 | Salibra | |
| 5,895,017 | A | 4/1999 | McMillan, Jr. | |
| 5,931,102 | A | 8/1999 | Grahl | |
| 6,003,826 | A | 12/1999 | Galloway, III | |
| 6,026,601 | A * | 2/2000 | Kiel | 38/137 |
| 6,148,738 | A * | 11/2000 | Richter | 108/44 |
| 6,474,244 | B1 * | 11/2002 | Karpinski | 108/42 |
| 6,705,235 | B1 * | 3/2004 | Gerutto | 108/47 |

FOREIGN PATENT DOCUMENTS

| | | | |
|---|---|---|---|
| JP | 03272708 A * | 12/1991 | A47B 57/04 |

* cited by examiner

*Primary Examiner*—Jose V. Chen

(57) ABSTRACT

A table and mounting combination includes an apparatus for removably mounting a tray on a railing that has an upper railing, a lower railing and a plurality of vertical members extending between the upper and lower railings. The apparatus includes a panel having an upper side, a lower side and a peripheral edge. A peripheral flange is attached to and extends downwardly from the peripheral edge. Each of a pair of mountings is removably positionable on the upper railing. Each of a pair of supports is removably attachable to one of the mountings such that the supports are in a generally horizontal orientation when each of the mountings are positioned on the upper rail. The panel may be removably positioned on the pair of mountings and the supports such that the panel is in a generally horizontal orientation.

4 Claims, 4 Drawing Sheets

TABLE AND MOUNTING COMBINATION

BACKGROUND OF THE INVENTION

1. Field of the Invention

The present invention relates to table devices and more particularly pertains to a new table device for selectively mounting a tray on a railing so that the tray may function as a table.

2. Description of the Prior Art

The use of table devices is known in the prior art. While these devices fulfill their respective, particular objectives and requirements, the need remains for a table that may be mounted on a railing so that the railing area may be used for the positioning of items in a convenient setting.

SUMMARY OF THE INVENTION

The present invention meets the needs presented above by providing a tray and mountings for removably mounting the tray on railing.

Another object of the present invention is to provide a new table device that includes feet on the tray. The feet space the tray from a surface upon which it sits so that if items are positioned on the tray, the tray may be easily lifted so that it may be brought to the mounting.

To this end, the present invention generally comprises an apparatus for removably mounting a tray on a railing that has an upper railing, a lower railing and a plurality of vertical members extending between the upper and lower railings. The apparatus includes a panel having an upper side, a lower side and a peripheral edge. A peripheral flange is attached to and extends downwardly from the peripheral edge. Each of a pair of mountings is removably positionable on the upper railing. Each of a pair of supports is removably attachable to one of the mountings such that the supports are in a generally horizontal orientation when each of the mountings are positioned on the upper rail. The panel may be removably positioned on the pair of mountings and the supports such that the panel is in a generally horizontal orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
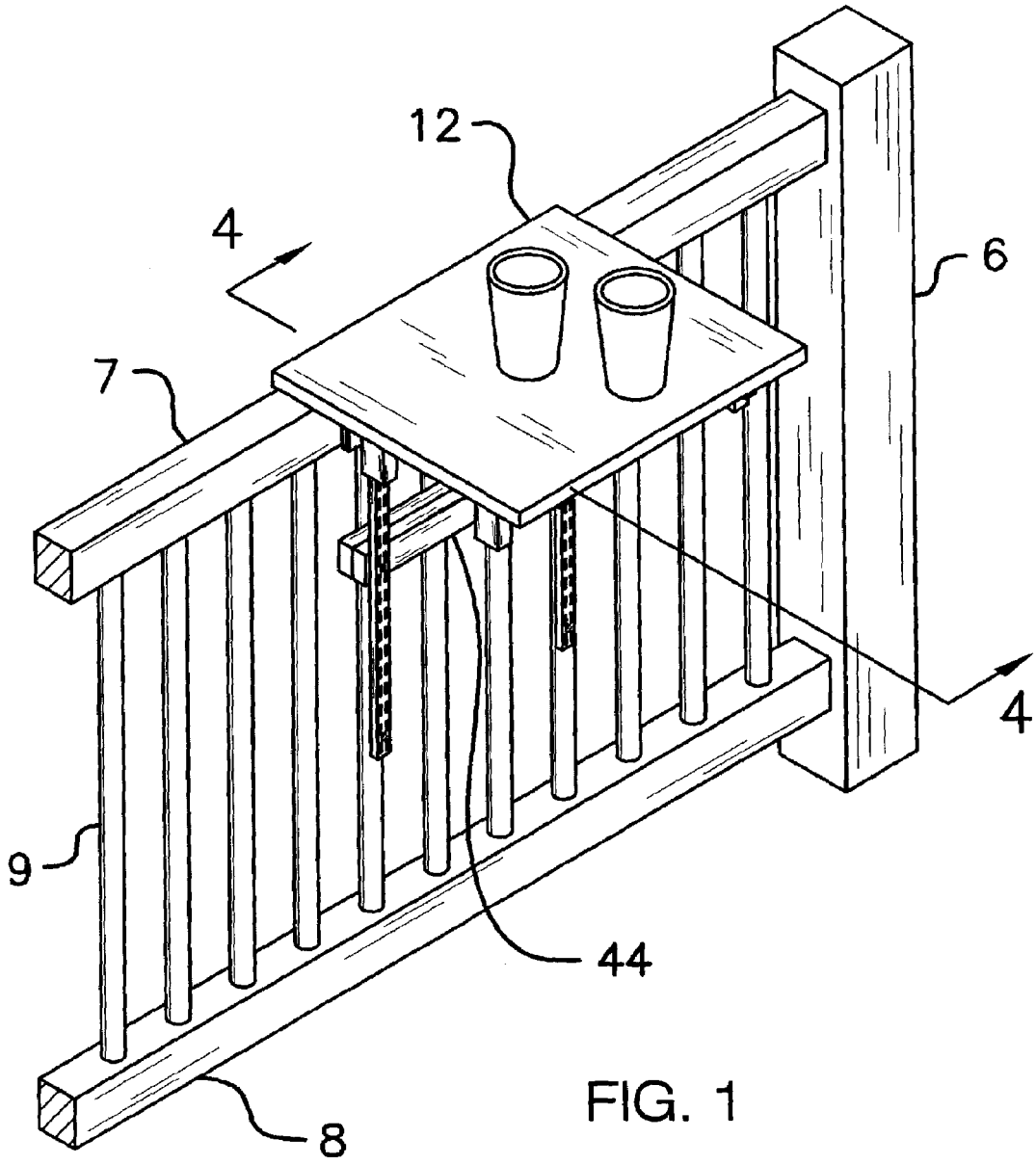
FIG. 1 is a schematic perspective in-use view of a table and mounting combination according to the present invention.
Figure 2:
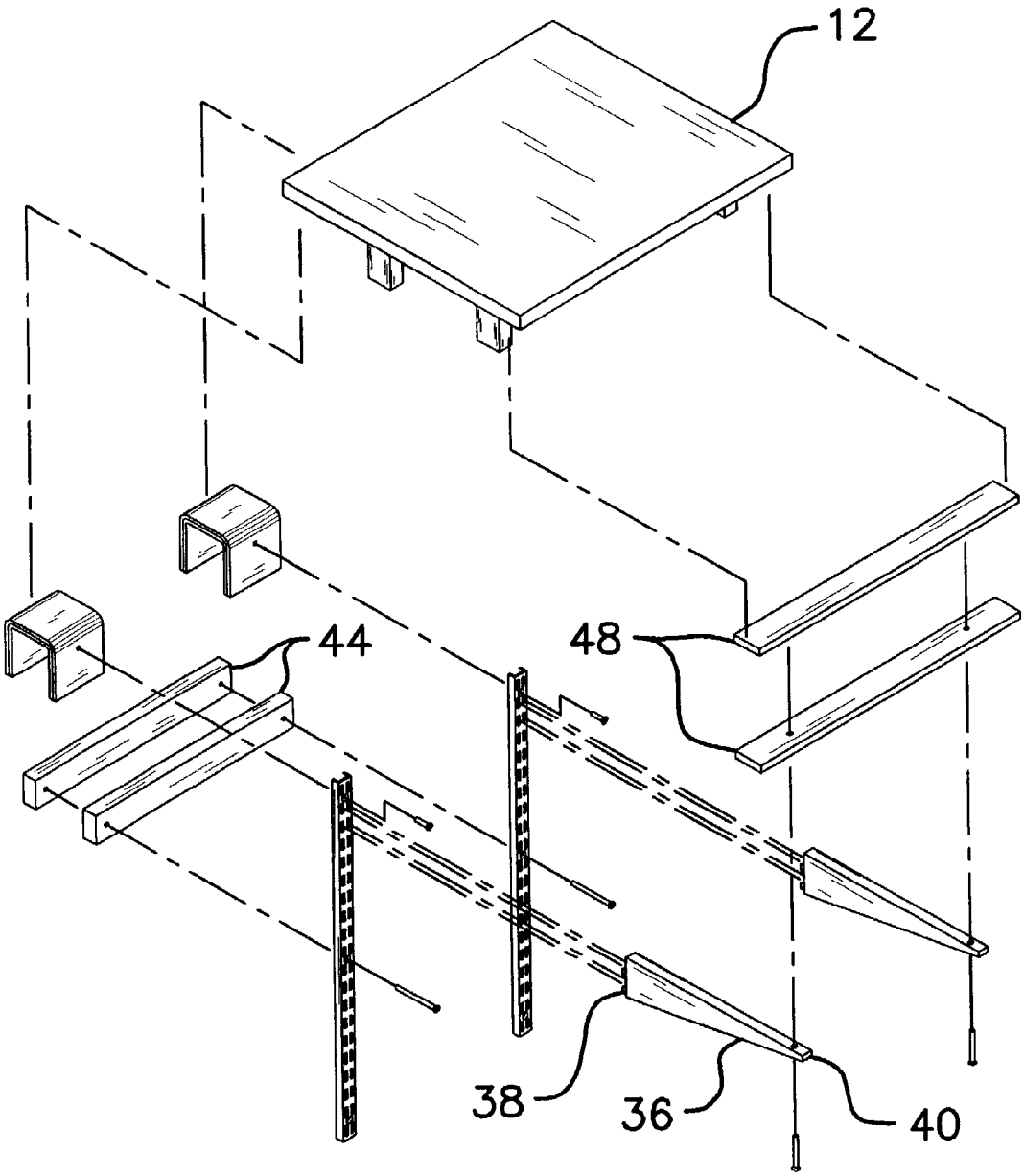
FIG. 2 is a schematic expanded view of the present invention.
Figure 3:
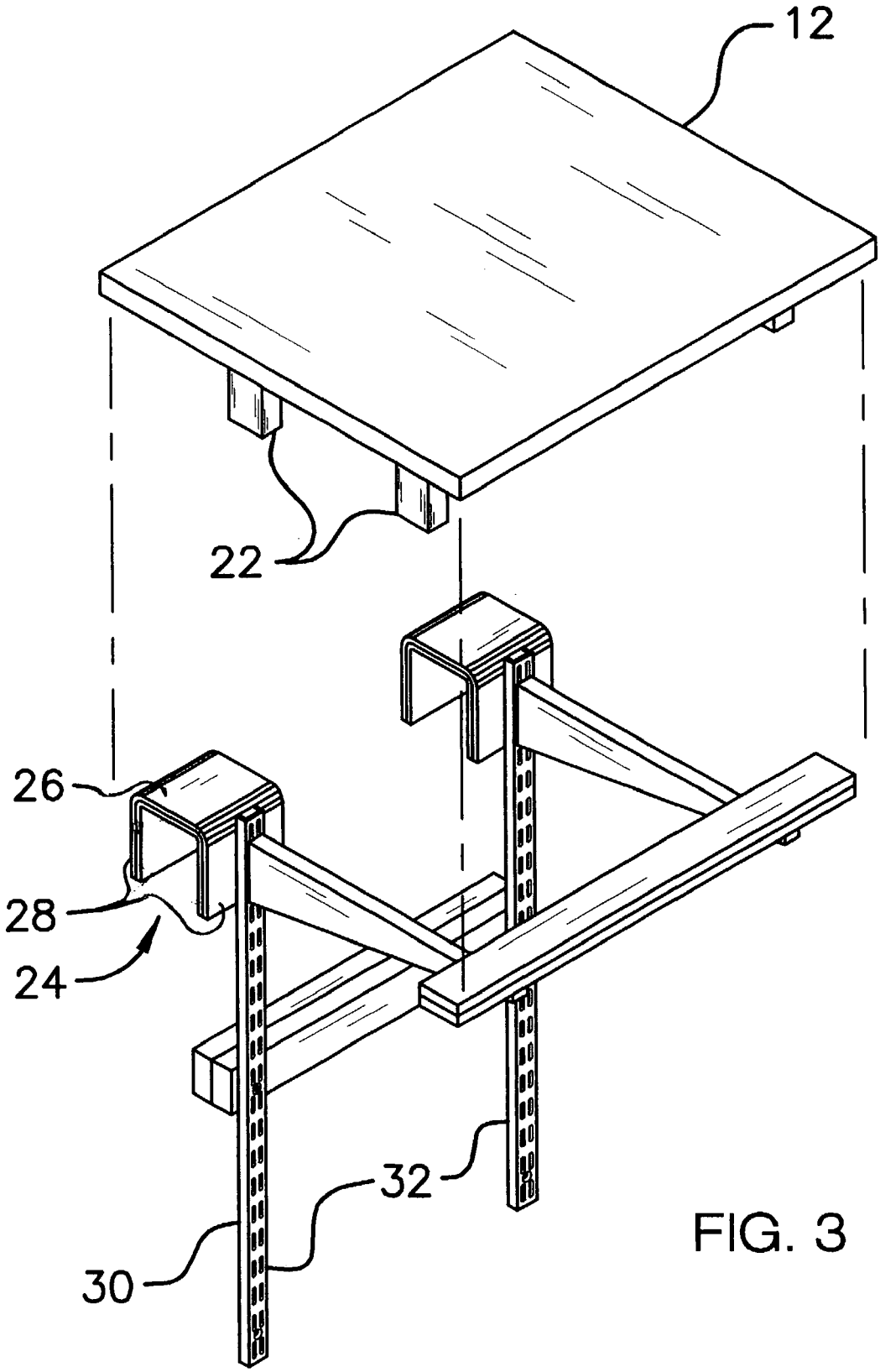
FIG. 3 is a schematic perspective view of the present invention.
Figure 4:
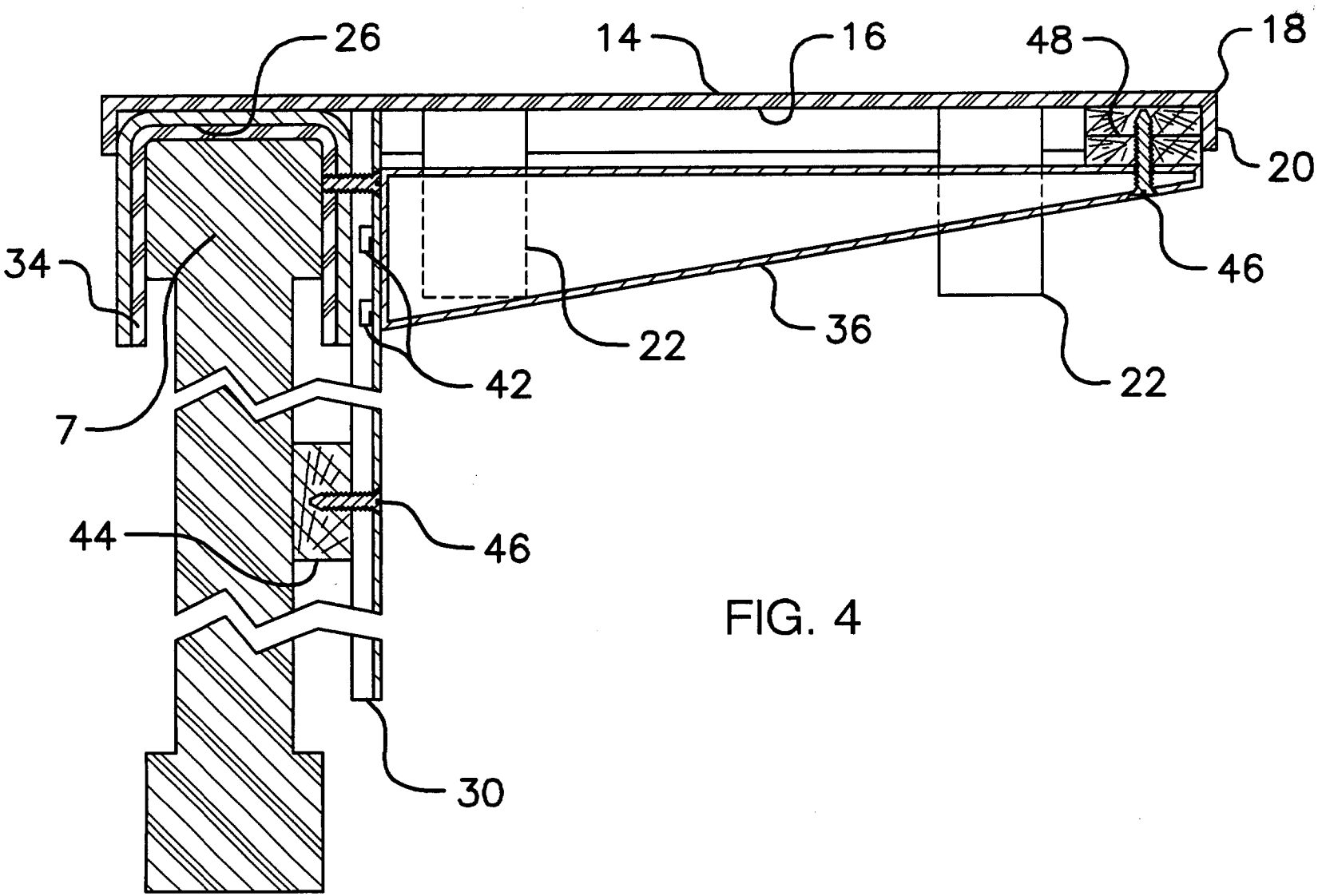
FIG. 4 is a schematic cross-sectional view taken along line 4—4 of FIG. 3 of the present invention.

With reference now to the drawings, and in particular to FIGS. 1 through 4 thereof, a new table device embodying the principles and concepts of the present invention and generally designated by the reference numeral 10 will be described.

As best illustrated in FIGS. 1 through 4, the table and mounting combination 10 generally comprises an apparatus for removably mounting a tray on a railing 6 that an upper railing 7, a lower railing 8 and a plurality of vertical members 9 extending between the upper 7 and lower 8 railings. The vertical members 9 may be posts or other type of support and walling used for railings. The apparatus, or combination 10, includes a panel 12 having an upper side 14, a lower side 16 and a peripheral edge 18. A peripheral flange 20 is attached to and extends downwardly from the peripheral edge 18. The panel 12 has a substantially rectangular shape. A plurality of feet 22 is preferably attached to the lower side 16 of the panel 12. Each of the feet 22 has a height of generally between 0.5 inches and 3 inches.

Each of a pair of mountings 24 is removably positionable on the upper railing 7. Each of the mountings 24 includes a horizontal plate 26 and a pair of legs 28 that are attached to extend downward from the horizontal plate 26. The legs 28 are spaced from each other such that each of the legs 28 is positionable adjacent to an opposite side of the upper railing 7 when the horizontal plate 26 is abutted against a top surface of the upper railing 7. An elongate member 30 is attached to an outer surface of the legs 28 and extends downwardly therefrom. The elongate member 30 has a longitudinal axis orientated substantially perpendicular to a plane of the horizontal plate 26. The elongate member 30 has a plurality of apertures 32 extending therethrough. Optionally, an inner surface of the horizontal plate 26 and legs 28 may be covered with a protective material 34.

Each of a pair of supports 36 is removably attachable to one of the mountings 24 such that the supports 36 are in a generally horizontal orientation when each of the mountings 24 is positioned on the upper rail 7. The supports 36 each include an arm having a first end 38 and a second end 40. A pair of latches 42 is attached to each of the first ends 38. The latches 42 are removably extendable into the apertures 32 for selectively securing the arms, or supports 36, to the elongate members 30.

A plurality of spacing members 44 is positionable between the elongate members 30 and the vertical members 9. Each of the spacing members 44 is removably attachable to the elongated members 30. The spacing members 44 may be stacked between the vertical members 9 and the elongate members 30 such that the elongate members 30 are supported in a vertical orientation. The spacing members 44 are preferably elongate such that they may be attached to each of the elongate members 30. The spacing members 44 may be secured to the elongate members 30 with conventional fasteners 46, such as screws.

In use, the mountings 24 are positioned in a spaced orientation on the upper rail 7 and the supports 36 attached thereto. The panel 12 is removably positioned on the pair of mountings 24 and the supports 36 such that the panel 12 is in a generally horizontal orientation. The panel 12 serves as a table which may be positioned on conventional railings and particularly those railings used for porches or balconies.

Optionally, secondary spacers 48 may be provided which may be positioned on the supports 36 for ensuring that the panel 12 is positioned in a horizontal orientation. The spacing members 44 and secondary spacers 48 may each include one or a plurality of pieces. Also, the secondary spacers 48, the spacing members 44, the supports 36, the elongate members 30 and the mountings may also be one item constructed in a fixed fashion so that they are not readily separable from each other. Fasteners 46 may be extended through the supports 36 and into the secondary spacers 48 to secure their position. The flange 20 on the panel 12 keeps the panel 12 on the supports 36 and mountings 24. The feet 22 are attached to the panel 12 to make it easier to lift off of a table surface after items have been placed on the panel 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tray mounting apparatus for removably mounting a tray on a railing having an upper railing, a lower railing and a plurality of vertical members extending between the upper and lower railings, said apparatus comprising:

a panel having an upper side, a lower side and a peripheral edge, a peripheral flange being attached to and extending downwardly from said peripheral edge;

a pair of mountings, each of said mountings being removably positionable on said upper railing, each of said mountings including, a horizontal plate and a pair of legs being attached to extending downward from said horizontal plate, said legs being spaced from each other such that each of said legs is positionable adjacent to an opposite side of the upper railing when said horizontal plate is abutted against a top surface of the upper railing;

an elongate member being attached to an outer surface of said legs and extending downwardly therefrom, said elongate member having a longitudinal axis orientated substantially perpendicular to a plane of said horizontal plate, said elongate member having a plurality of apertures extending therethrough, each of said supports including an arm having a first end and a second end;

a pair of supports, each of said supports being removably attachable to one of said mountings such that said supports are in a generally horizontal orientation when each of said mountings are positioned on the upper rail, a pair of latches being attached to each of said first ends, said latches being removably extendable into said apertures for selectively securing said arms to said elongate members; and wherein said panel may be removably positioned on said pair of mountings and said supports such that said panel is in a generally horizontal orientation.

2. The tray mounting apparatus of claim 1, further including a plurality of feet being attached to said lower side of said panel, each of said feet having a height of generally between 0.5 inches and 3 inches.

3. The tray mounting apparatus of claim 1, further including a plurality of spacing members for positioning between said elongate members and the vertical members, each of said spacing members being removably attachable to said elongated members, wherein said spacing members may be stacked between said vertical members and said elongate members such that said elongate members are supported in a vertical orientation.

4. A tray mounting apparatus for removably mounting a tray on a railing having an upper railing, a lower railing and a plurality of vertical members extending between the upper and lower railings, said apparatus comprising:

a panel having an upper side, a lower side and a peripheral edge, a peripheral flange being attached to and extending downwardly from said peripheral edge, said panel having a substantially rectangular shape, a plurality of feet being attached to said lower side of said panel, each of said feet having a height of generally between 0.5 inches and 3 inches;

a pair of mountings, each of said mountings being removably positionable on said upper railing, each of said mountings including;

a horizontal plate and a pair of legs being attached to extending downward from said horizontal plate, said legs being spaced from each other such that each of said legs is positionable adjacent to an opposite side of the upper railing when said horizontal plate is abutted against a top surface of the upper railing;

an elongate member being attached to an outer surface of said legs and extending downwardly therefrom, said elongate member having a longitudinal axis orientated substantially perpendicular to a plane of said horizontal plate, said elongate member having a plurality of apertures extending therethrough;

a pair of supports, each of said supports being removably attachable to one of said mountings such that said supports are in a generally horizontal orientation when each of said mountings are positioned on the upper rail, each of said supports including an arm having a first end and a second end, a pair of latches being attached to each of said first ends, said latches being removably extendable into said apertures for selectively securing said arms to said elongate members;

a plurality of spacing members for positioning between said elongate members and the vertical members, each of said spacing members being removably attachable to said elongated members, wherein said spacing members may be stacked between said vertical members and said elongate members such that said elongate members are supported in a vertical orientation; and wherein said panel may be removably positioned on said pair of mountings and said supports such that said panel is in a generally horizontal orientation.

* * * * *